US005267453A

United States Patent [19]

Peake, III et al.

[11] Patent Number: 5,267,453

[45] Date of Patent: Dec. 7, 1993

[54] LOOP-TYPE TEXTILE FASTENER FABRIC AND METHOD OF PRODUCING SAME

[75] Inventors: William L. Peake, III; Robert T. Spillane, both of Greensboro, N.C.

[73] Assignee: Guilford Mills, Inc., Greensboro, N.C.

[21] Appl. No.: 34,088

[22] Filed: Mar. 22, 1993

Related U.S. Application Data

[63] Continuation-in-part of Ser. No. 711,201, Jun. 6, 1991, Pat. No. 5,214,942.

[51] Int. Cl.[5] ..... D04B 23/08; A44B 18/00

[52] U.S. Cl. ..... 66/194; 66/193; 24/445

[58] Field of Search ..... 66/193, 194; 24/445

[56] References Cited

U.S. PATENT DOCUMENTS

| | | | |
|---|---|---|---|
| 3,594,873 | 7/1971 | Hockmeyer, Jr. et al. . | |
| 3,597,941 | 8/1971 | Domazlice . | |
| 3,603,117 | 9/1971 | Svoboda et al. | 66/194 X |
| 3,748,701 | 7/1973 | De Mestral . | |
| 3,943,981 | 3/1976 | De Brabander . | |
| 4,114,346 | 9/1978 | Kelly . | |
| 4,338,800 | 7/1982 | Matsuda . | |
| 4,467,625 | 8/1984 | Kurz . | |
| 4,557,774 | 12/1985 | Hoopengardner . | |
| 4,567,075 | 1/1986 | Krawczyk | 66/194 X |
| 4,624,116 | 11/1986 | Rogers . | |
| 4,677,011 | 6/1987 | Matsuda . | |
| 4,709,562 | 12/1987 | Matsuda . | |
| 4,714,096 | 12/1987 | Guay . | |
| 4,822,658 | 4/1989 | Pacione . | |
| 4,838,044 | 6/1989 | Matsuda et al. . | |
| 4,858,447 | 8/1989 | Matsuda . | |
| 4,881,383 | 11/1989 | Spillane et al. . | |
| 5,065,600 | 11/1991 | Byles | 66/194 X |

FOREIGN PATENT DOCUMENTS

| | | |
|---|---|---|
| 0062738 | 4/1981 | European Pat. Off. . |
| 0223024 | 10/1985 | European Pat. Off. . |
| 0284020 | 3/1987 | European Pat. Off. . |
| 7030645 | 11/1970 | Fed. Rep. of Germany . |
| 2201231 | 7/1973 | Fed. Rep. of Germany . |
| 2647113 | 5/1977 | Fed. Rep. of Germany . |
| 2803006 | 8/1979 | Fed. Rep. of Germany . |
| 2150196 | 3/1973 | France . |
| WO86/03164 | 6/1986 | PCT Int'l Appl. . |
| 1204886 | 9/1967 | United Kingdom . |

OTHER PUBLICATIONS

Guilford Mills, Inc., Warp Knitted Fabric Style No. 30000.

*Primary Examiner*—Clifford D. Crowder
*Assistant Examiner*—John J. Calvert
*Attorney, Agent, or Firm*—Shefte, Pinckney & Sawyer

[57] ABSTRACT

A lightweight warp knitted textile fabric suitable for use as the loop component of a hook-and-loop fastener is formed of a set of ground yarns knitted in a relatively stretchable construction with a first set of loop forming yarns formed in a stitch pattern producing elongated underlap loops extending outwardly from the technical back of the fabric which can be readily interengaged with the hook elements of a mating hook component without any necessity for brushing, napping or mechanically raising the loops and a second set of loop-forming yarns formed in a stitch pattern producing elongated loops extending outwardly from the technical face of the fabric which can be adhered to a backing material such as a carpet backing.

14 Claims, 2 Drawing Sheets

LOOP-TYPE TEXTILE FASTENER FABRIC AND METHOD OF PRODUCING SAME

CROSS-REFERENCE TO RELATED APPLICATION

This is a continuation-in-part of copending U.S. patent application Ser. No. 07/711,201, filed Jun. 6, 1991, now U.S. Pat. No. 5,214,942 entitled LOOP-TYPE TEXTILE FASTENER FABRIC AND METHOD OF PRODUCING SAME.

BACKGROUND OF THE INVENTION

The present invention relates generally to fabric fasteners of the type commonly referred to as hook-and-loop fasteners. More particularly, the present invention relates to a novel warp knitted loop-type textile fastener fabric and a method of producing such a fastener fabric on a warp knitting machine.

So-called hook-and-loop fasteners have gained considerable popularity over recent years. Such fasteners basically include two generally flat components attachable and detachable to and from face abutting relation with one another. Typically, each fastener component is of a textile fabric construction, the hook or "male" component having a fabric ground layer with a plurality of relatively stiff hook-shaped elements extending in upstanding relation from one face of the ground layer and the loop or "female" component similarly having a fabric ground layer with a plurality of relatively flexible pile-type loops extending outwardly from one face of the ground layer. In use, the hook and loop faces of the fastener components grippingly engage one another when pressed together in face abutting relation by penetration of the hook-shaped elements of the hook component into the loops at the opposing face of the loop component. The engagement between the hook and loop faces of the two components resists separation thereof until a threshold force is exerted on one component in a peeling-like fashion.

Typically, both components of conventional hook-and-loop fasteners have been of relatively heavyweight constructions. For example, many hook components utilize hook elements formed of relatively heavy denier inflexible synthetic monofilament yarns firmly secured in a similarly stiff inflexible ground fabric, to withstand repeated attachment and detachment to and from a mating loop component without excessive breakage of the hook elements or tearing of the ground fabric. Similarly, loop components commonly have a relatively stiff inflexible ground layer supporting elongated loops of multifilament synthetic yarns, which normally are brushed or napped to produce a plush-like loop surface wherein the individual filaments are mainly separated from one another, in order to maximize the available loops for engagement with the mating hook-like elements of the other fastener component. Thus, although a number of the individual filaments in the loops may be broken each time the hook and loop components are attached and then detached, the large number of available loops owing to the use of napped or brushed multifilament yarns enables the loop component to be repeatedly attached and detached to and from its mating hook component so that the fastener generally has a reasonably extended useful life.

Virtually without exception, conventional hook-and-loop fasteners are fabricated with each fastener component in the form of a relatively narrow width tape of indeterminate length. As such, hook-and-loop fasteners are susceptible to a wide variety of end uses, most often as a fastener or closure in various apparel items wherein the capability of the fastener components for repetitive attachment and detachment to and from one another is a virtual necessity.

However, a variety of other uses for hook-and-loop fasteners has also been proposed. For example, U.S. Pat. No. 4,822,658 discloses a carpet construction with a backing layer having plural downwardly projecting loops serving the dual purpose of providing resiliency to the underside of the carpet in the nature of underpadding while also being adapted for engagement with a hook-type fastener tape affixed to a floor surface for purposes of securing the carpeting in place on the floor. To economically produce this product, a loop-type fastener component for use as the backing layer must be fabricated in the same widths as carpeting is typically fabricated, e.g., twelve-foot widths or greater. However, no conventional hook-and-loop fastener constructions are known to be fabricated in such widths to be suitable for the use contemplated by this patent. Moreover, since the looped underlayer of this carpet construction would not be repeatedly engaged with and disengaged from the mating hook fastener tape but instead would generally perform a one-time use, the loop components of conventional hook-and-loop fasteners of the type described above would not be optimally suitable for use in such carpet construction in any event.

Other uses which have been proposed for hook-and-loop fasteners include the formation of closures in disposable or one-time use products, such as diapers and incontinence garments, for which the above-described conventional hook-and-loop fasteners would also be generally inappropriate.

SUMMARY OF THE INVENTION

It is accordingly an object of the present invention to provide a novel loop component for use in a hook-and-loop fastener which is suitable for uses wherein repeated attachment and detachment to and from a mating hook component is generally unnecessary. A particular object of the present invention is to provide such a loop component which is specifically suitable for use as a backing in a carpet construction such as disclosed in the aforementioned U.S. Pat. No. 4,822,658, closures for disposable articles, and in other one-time and light-duty uses.

It is a further object of the present invention to provide a loop component for a hook-and-loop fastener of a warp knitted textile fabric construction wherein the loop-forming yarn is knitted in a stitch pattern causing the surface loops to be elongated and to extend outwardly from the fabric without brushing, napping or otherwise mechanically raising the loops. A more specific object is to provide such a loop component utilizing a relatively fine denier synthetic yarn for formation of the surface loops on one face of the fastener component.

An additional object of the present invention is to provide a novel warp knitting method for fabricating the loop fastener component of the present invention.

Briefly summarized, the present invention provides a textile fabric having a first set of loops at one face adapted to be adhered to a backing material (e.g., the backing surface of a carpet) and a second set of loops at the other face adapted for mated engagement with hooking elements of another fabric for use in a two-component fabric fastener of the hook-and-loop type. Basically, the fabric fastener component of the present invention includes a ground layer formed of a ground yarn and first and second loop-forming yarns forming the first and second sets of loops and extending outwardly from the opposite faces of the ground layer. According to one aspect of the present invention, the fastener fabric is formed of a warp knitted construction with the first set of adherable loops appearing at the technical face of the fabric and the second set of fastener loops appearing at the technical back of the fabric. More specifically, the warp knitted fastener component includes yarns formed in needle loops arranged in longitudinally extending wales and transversely extending courses including a set of ground yarns formed in a stitch pattern of needle loops which is relatively stretchable in the warpwise extent of the fabric, a first set of loop-forming yarns knitted with the ground yarns at the technical back of the fabric in needle loops in spaced courses and spaced wales wherein the ground yarn needle loops are formed and in elongated underlap loops extending outwardly from the technical back of the fabric between the needle loops of the first loop-forming yarns, and a second set of loop-forming yarns knitted with the ground yarns at the technical face of the fabric in needle loops in spaced courses and spaced wales wherein the ground yarn needle loops are formed and in loops extending outwardly from the technical face of the fabric between the needle loops of the second loop-forming yarns.

Preferably, each loop-forming yarn is formed in needle loops aligned with one another in spaced courses of a common wale. For example, the first loop-forming yarns may be warp knitted in a 1–0, 3–4, 6–7, 3–4 stitch pattern, while the second loop-forming yarns are warp knitted in a 1–0, 3–4 stitch pattern. It is also preferred that the ground yarns are formed in a 2–3, 1–0 stitch pattern.

The present invention also contemplates a method of producing a warp knitted textile fabric suitable for use as the loop component of a hook-and-loop type fastener. Basically, the present method includes the steps of warp knitting a set of ground yarns on the middle guide bar of a three-bar warp knitting machine to form a ground layer of the fabric in a relatively stretchable construction while simultaneously warp knitting a first set of loop-forming yarns on the top guide bar of the knitting machine in elongated underlaps forming raised loops at the technical back of the fabric and a second set of loop-forming yarns on the bottom guide bar of the knitting machine in loops extending from the technical face of the fabric.

According to one aspect of the present method, the loop-forming yarns are knitted by alternately forming needle loops of the loop-forming yarns on selected needles of the knitting machine's needle bar and interveningly holding the loop-forming yarns in a non knitting manner on, and then releasing the loop-forming yarns without stitch formation from, other needles spaced from the selected needles to form the respective outwardly-extending loops at the technical face and back of the fabric between the respective needle loops of the loop-forming yarns.

In the preferred embodiment of the present method, the round yarns are warp knitted in a 2–3, 1–0 stitch pattern, the first loop-forming yarns are warp knitted in a 1–0, 3–4, 6–7, 3–4 stitch pattern, and the second loop-forming yarns are warp knitted in a 1–0, 3–4 stitch pattern.

DESCRIPTION OF THE PREFERRED EMBODIMENT

Figure 1:
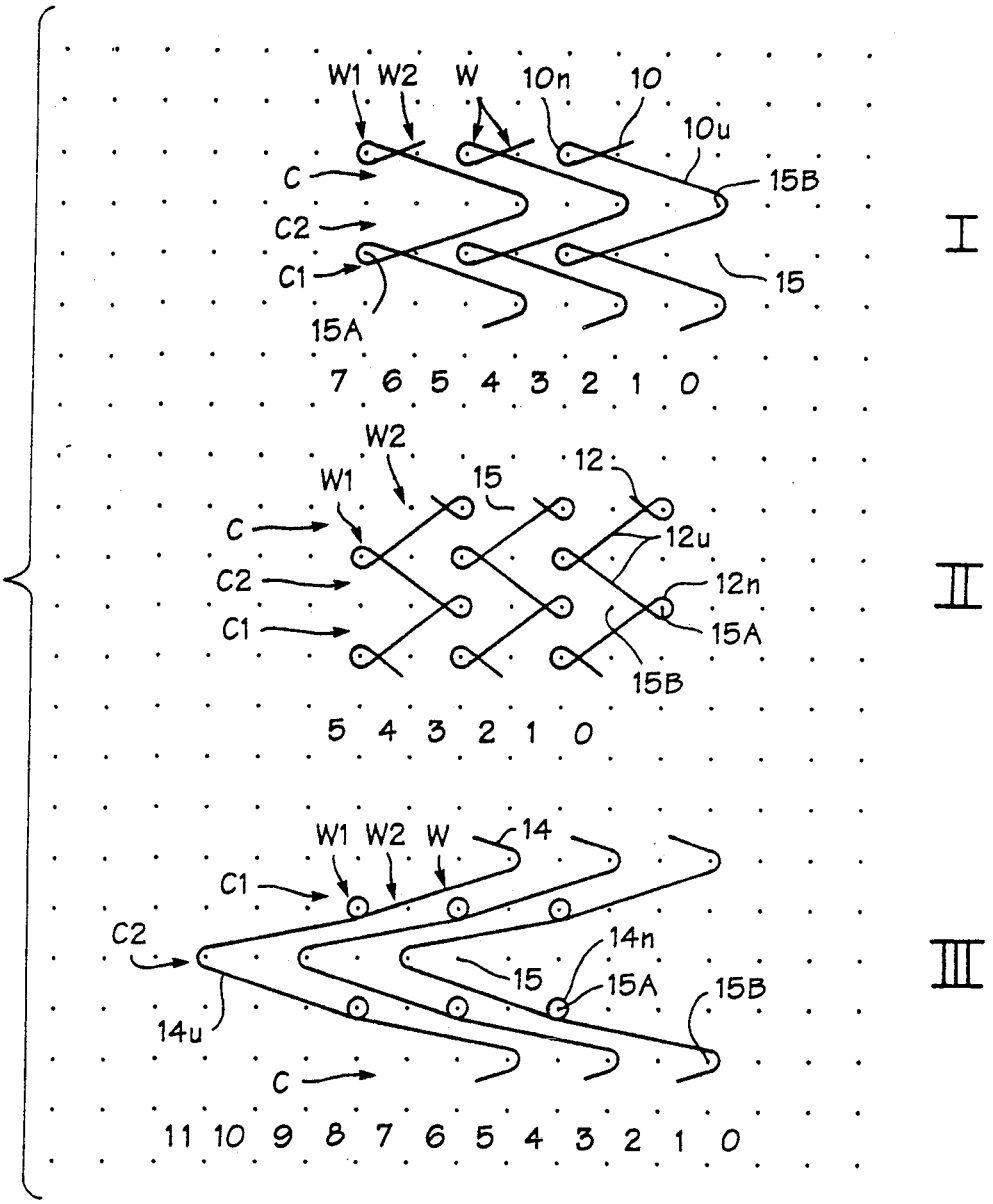
FIG. 1 is a diagram showing individually the stitch pattern for the ground and loop-forming yarns carried out by a warp knitting machine in knitting one preferred embodiment of the present fabric according to the method of the present invention.

As explained more fully herein, the preferred embodiment of the fabric of the present invention is produced, and the method of the present invention is carried out, on a warp knitting machine which may be of any conventional type of an at least three-bar construction having three or more yarn guide bars and a needle bar, e.g., a conventional tricot warp knitting machine. The construction and operation of such machines are well known in the warp knitting art and need not herein be specifically described and illustrated. In the following description, the yarn guide bars of the knitting machine are identified as "top," "middle" and "bottom" guide bars for references purposes only and not by way of limitation. As those persons skilled in the art will understand, such terms equally identify knitting machines whose guide bars may be referred to as "front," "middle" and "back" guide bars, which machines of course are not to be excluded from the scope and substance of the present invention. As further used herein, the "bar construction" of a warp knitting machine refers to the number of yarn guide bars of the machine, while the "bar construction" of a warp knitted fabric refers to the number of different sets of warp yarns included in the fabric, all as is conventional terminology in the art.

Referring now to the accompanying drawings, one particular embodiment of the present textile fabric is illustrated as preferably warp knitted of a three-bar construction on a three-bar warp knitting machine according to the present method. As is conventional, the needle bar of the warp knitting machine carries a series of aligned knitting needles, while each guide bar of the machine carries a series of guide eyes, the needle and guide bars preferably having the same gauge, i.e., the same number of needles and guide eyes per inch. According to the illustrated embodiment of the present fabric, the top guide bar of the machine is threaded on alternating guide members with a first set of loop-forming yarns 14 delivered from a warp beam (not shown), the middle guide bar is threaded on alternating guide members with a set of ground yarns 12 delivered from another warp beam (also not shown), and the bottom guide bar is similarly threaded on alternating guide members with a second set of loop-forming yarns 10 supplied from a third warp beam (also not shown). For this purpose, each of the bottom, middle and top yarn guide bars has every alternate guide eye empty and every intervening guide eye threaded with a respective ground or loop-forming yarn 10, 12 or 14, commonly referred to as a "one out, one in" threading arrangement. As more fully explained hereinafter, the threading arrangement of the three guide bars is set up in conjunction with the stitch patterns of the three sets of yarn to deliver the ground and loop-forming yarns 10,12,14 to every alternate needle of the needle bar during the formation of alternate fabric courses and, then, to deliver the ground yarn 12 to every alternate needle of the needle bar while delivering the loop-forming yarns 10,14 to every intervening needle during the formation of intervening fabric courses.

It is contemplated that a variety of yarns may be suitable for use as the ground and loop-forming yarns. For example, any of a variety of conventional multifilament synthetic yarns, particularly polyester and nylon yarns, would be suitable for use as any or all of the ground and loop-forming yarns. Texturized yarns offer the additional advantage of enhancing the desired stretchability of the fabric. The denier of the yarns may vary depending upon the desired weight of the fabric per unit fabric dimension (ounces per square yard).

In the accompanying FIG. 1, the stitch constructions of the ground and loop-forming yarns 10,12,14, as carried out by the respective lateral traversing movements of the guide bars of the knitting machine according to one possible embodiment of the present fabric and method, are illustrated individually in a traditional dot or point diagram format, wherein the individual points 15 represent the needles of the needle bar of the knitting machine in the formation of several successive fabric courses C across several successive fabric wales W. According to this embodiment, the bottom (or back) guide bar of the warp knitting machine manipulates the second set of loop-forming yarns 10 as they are fed from their respective warp beam to traverse laterally back and forth relative to the needle bar of the machine alternately to stitch the loop-forming yarns 10 on alternate needles 15A and then to lay the yarns 10 without stitch formation about the intervening needles 15B in a repeating 1–0, 3–4 stitch pattern, as indicated at I of FIG. 1. Similarly, the top (or front) guide bar simultaneously manipulates the first set of loop-forming yarns 14 as they are fed from their respective warp beam to traverse relative to the needle bar alternately to stitch the loop-forming yarns 14 on the same alternating needles 15A and then to lay the yarns 14 without stitch formation about spaced intervening needles 15B in a repeating 1–0, 3–4, 6–7, 3–4 stitch pattern, as indicated at III of FIG. 1. Simultaneously, the middle guide bar of the knitting machine manipulates the set of ground yarns 12 as they are fed from their respective warp beam to traverse relative to the needle bar in opposition to the top and bottom guide bars to stitch the ground yarns 12 on the same alternating needles 15A in a repeating 2–3, 1–0 stitch pattern, as indicated at II in FIG. 1. The respective simultaneous stitch patterns of the ground and loop-forming yarns 10,12,14 are shown in a composite dot diagram in FIG. 2.

As will thus be understood, the ground and loop-forming yarns 10,12,14 are interknitted with one another by formation of respective needle loops **10*n*,12*n*,14*n* of the yarns in alternating wales W1 and alternating courses C1 of the resultant fabric, without any needle loops of any of the yarns being formed in the intervening wales W2 and only needle loops 12*n* of the ground yarns 12 being formed in the alternating wales W1 of the intervening courses C2. More specifically, the stitch construction of the first loop-forming yarns 10 forms needle loops 10*n* thereof only in alternating wales W1 of alternating courses C1, each individual loop-forming yarn 10 having its respective needle loops 10*n* formed in alternating courses C1 and in a single common wale W1 with connecting underlap extents 10*u* extending between the successive needle loops 10*n* generally in the intervening courses C2. The ground yarns 12 are formed only in the alternating wales W1, each individual ground yarn 12 having its respective needle loops 12*n* alternating every course C between adjacent alternate wales W1 across the one intervening wale W2 across which underlaps 12*u* of the ground yarn extend diagonally back and forth in a substantially coursewise direction between the successive needle loops 12*n*. The stitch construction of the loop-forming yarns 14 form them in needle loops 14*n* appearing only in the alternating courses C1 and in the alternating wales W1, each individual loop-forming yarn 14 having its respective needle loops 14*n* formed in the alternating courses C1 in a single common wale W1 with connecting underlap extents 14*u* extending between the successive needle loops 14*n* generally in the intervening courses C2**.

As those persons skilled in the art will recognize, the respective stitch patterns followed by the loop-forming yarns 10,14 cause each such yarn to be traversed during the formation of each intervening course C2 across a three-needle spacing from the needle 15A on which was formed a needle loop **10*n*,14*n* in the formation of the preceding course C1 to cause the yarns 10,14 to extend in a non-knitting manner about the spaced needle 15B. Such needles 15B hold the loop-forming yarns 10,14 during the formation of the intervening courses C2 and then subsequently shed the yarns 10,14 without formation of needle loops thereof upon formation of the next succeeding alternate course C1 and, since such needles are not involved in the formation of needle loops of the ground yarns 12 during the formation of any of the courses C1,C2, the held extents of the loop-forming yarns 10,14 do not become anchored in the fabric. As a result, the underlap extents 14*u* of the second loop-forming yarns 14 are substantially elongated and are free to extend outwardly as pile-like loops from the corresponding face of the fabric, i.e. the technical back thereof. Likewise, the underlap extents 10*u* of the first loop-forming yarns 10** are elongated and free to extend outwardly from the corresponding face of the fabric, i.e., the technical face, as more fully explained below.

In this fashion, the ground yarns 12 form a base or ground fabric structure which integrates the yarns 10,12,14 into the fabric, the coursewise alternating stitch construction of the ground yarns 12 permitting a corresponding degree of walewise stretchability of the fabric.

Figure 2:
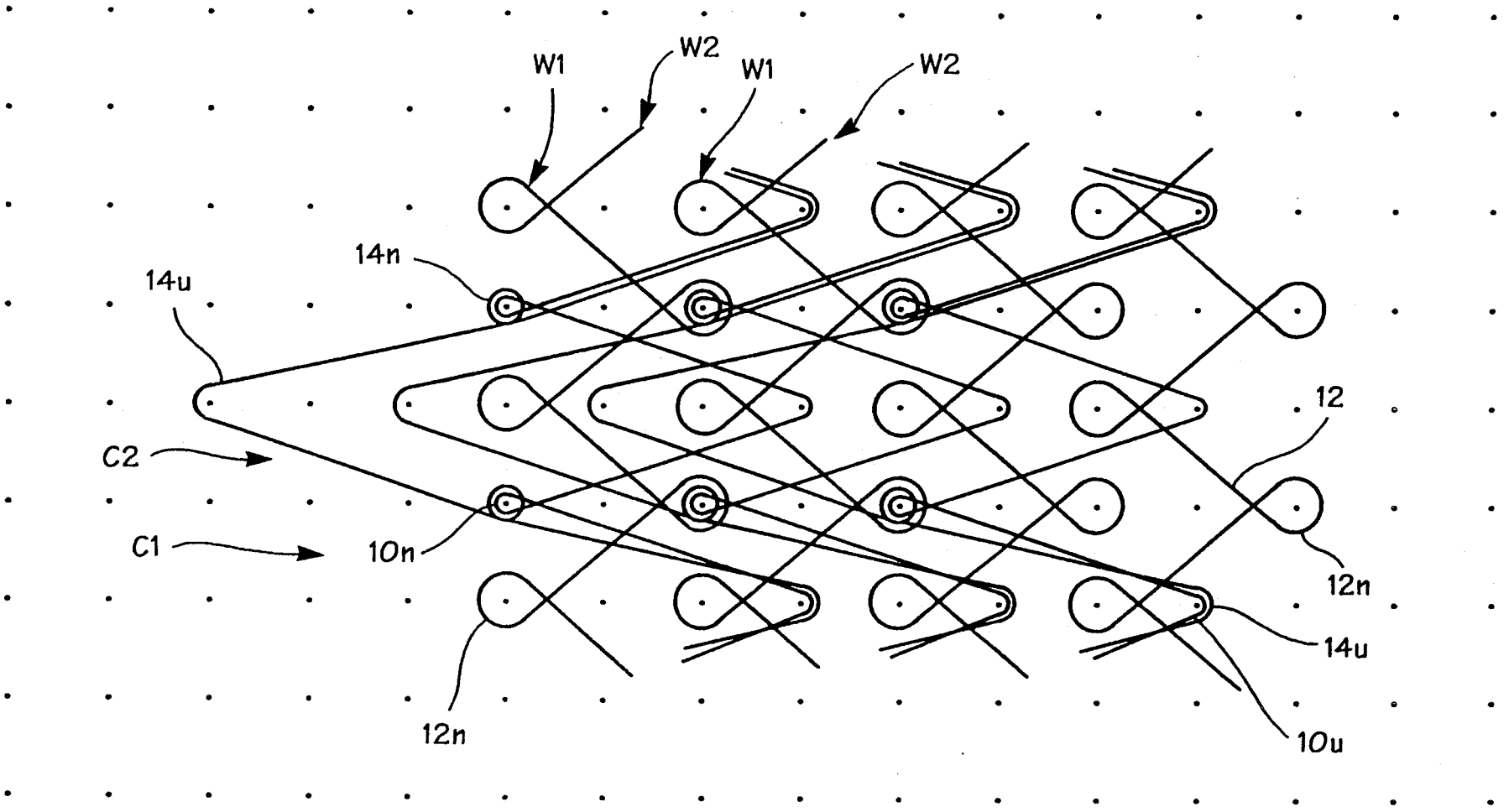
FIG. 2 is a composite diagram thereof.

The formation of the loop-forming yarns 14 on the top (front) guide bar of the knitting machine forms such yarns predominantly at the technical back of the fabric whereat the extended underlaps **14*u* extend generally outwardly of the fabric surface in the nature of elongated terry pile loops. Because of the particular stitch construction of the loop-forming yarns 14, the successive underlap loops 14*u* of each yarn 14 are formed during opposing lateral movements of the top guide bar and therefore the underlap loops 14*u* in the resultant fabric tend to lean coursewise alternately in opposite directions relative to the needle loops 14*n*, as depicted in FIGS. 1 and 2. As a result, the underlap loops 14*u* produced by the present fabric construction make the fabric well suited for use as the loop component of a hook-and-loop fastener, the outwardly extending disposition of the underlap loops 14*u* orienting them optimally for engagement with the hook elements of a mating fastener hook component, which could be of a variety of conventional constructions. Advantageously, the elongated nature of the underlap loops 14*u*** provides sufficient loop elevation from the fabric surface that napping, brushing or other mechanical raising of the loops, which is conventionally necessary in other fastener loop fabric constructions, can be avoided altogether.

The formation of the loop-forming yarns 10 on the bottom (back) guide bar of the knitting machine forms such yarns predominantly at the technical face of the fabric. Thus, although the underlaps 10*u* would normally tend to appear at the technical back of the fabric, because of the presence of the ground structure formed by the ground yarns 12, the underlaps 10*u* are caused to project from the technical face of the fabric, but to a lesser projecting elevation than the loops 14*u* of the first loop-forming yarns 14 at the technical back. Since the underlaps 10*u* of the second loop-forming yarns 10 are always formed during lateral movements of the bottom guide in the same direction, then in contrast to the loops 14*u* of the yarns 14, the underlap loops 10*u* in the resultant fabric tend to project in the same direction as each other, thereby forming a walewise ribbed effect at the technical face of the fabric. Advantageously, the projecting loops 10*u* facilitate adhesion of the technical face of the fabric to a substrate or backing material, leaving the technical back exposed to serve a fastening function, as more fully explained below.

In use, the fabric of the present invention provides several distinct advantages over conventional fastener loop fabric construction. By selecting the ground and loop-forming yarns to be of relatively fine denier, the present fastener loop fabric construction can be made significantly lighter in weight per unit fabric dimension than corresponding conventional fastener loop fabric constructions. Further, manufacture of the present fabric construction is expedited and simplified by avoiding the necessity of brushing, napping or otherwise raising the fastener loops 14*u*. As a result, the manufacturing cost of the present fabric can be relatively reduced in comparison to conventional fastener loop fabrics. While the number of available fastener loops 14*u* provided by the present fabric construction may be relative reduced in comparison to conventional fastener fabric constructions, the elongated upstanding nature of the loops 14*u* formed by the present construction together with the opposing coursewise leaning of the loops provides optimal interengagement between the loops and the hook elements of a mating hook-type fastener component so that the peel force value, i.e., the force required to peel a hook fabric component from the present loop fabric, and the shear force value, i.e., the force required to pull a hook fabric component from the present loop fabric component in a direction parallel to the loop fabric component, compare favorably with conventional fastener loop fabric constructions.

Accordingly, the fastener loop fabric construction of the present invention, owing to its provision of suitable functional characteristics at relatively lower cost and lighter weight than conventional fastener loop fabric constructions, is believed to be highly suitable for various forms of one-time and disposable uses such as, for example, use as a carpet backing of the type contemplated in aforementioned U.S. Pat. No. 4,822,658. In particular, when the present fabric is used as a carpet backing as disclosed in U.S. Pat. No. 4,822,658, the ribbed formation of the projecting loops 10*u* at the technical face of the fabric enable the fabric to be adhesively anchored by such loops in the foamed backing material of conventional carpets without necessarily adhering the ground structure of the present fabric in the carpet backing, whereby the natural walewise stretchability of the present fabric is not inhibited thus permitting the fabric to stretch and move relative to the carpet and its backing so that the adherence of the present fabric to the carpet does not affect the normal performance characteristics of the carpet.

It will be recognized by those persons skilled in the art that the particular yarns and yarn sizes (denier), as well as the particular stitch patterns followed by the constituent yarns, may be selectively varied, as desired, to modify the properties and characteristics of the resultant fabric to achieve differing embodiments of the fabric suited to differing uses, so long as the stitch construction of the several yarns in selected to achieve elongated underlaps of the loop-forming yarns which are not anchored into the fabric structure so as to permit the underlaps to extend outwardly from the resultant fabric in the nature of pile loops. Likewise, it is contemplated that the fastener loop fabric of the present invention could be of a four bar construction rather than a three bar construction, if desirable to achieve additional or different fabric properties. All such modifications and variations on the present invention are intended to be within the scope of the present invention.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A warp knitted textile fabric having a first set of loops extending from the technical face of the fabric for adhering to a backing material and a second set of loops extending from the technical back of the fabric for mated engagement with hooking elements of another fabric for use in a two-component fabric fastener of a hook-and-loop type, said fabric comprising yarns formed in needle loops arranged in longitudinally extending wales and transversely extending courses including at least one set of ground yarns formed in a stitch pattern of needle loops which is stretchable in the walewise extent of the fabric, a first set of loop-forming yarns knitted with said ground yarns at the technical back of said fabric in needle loops in spaced courses and spaced wales and in elongated pile-like underlap loops extending outwardly from the technical back of said fabric, and a second set of loop forming yarns knitted with said ground yarns at the technical face of said fabric in needle loops in spaced courses and spaced wales and in pile like loops extending outwardly from the technical face of said fabric.

2. A warp knitted textile fabric according to claim 1, wherein each said first loop forming yarn is formed in needle loops aligned with one another in spaced courses of a common wale.

3. A warp knitted textile fabric according to claim 1, wherein each walewise adjacent pair of said needle loops of said first loop-forming yarns are spaced by at least one intervening course and each coursewise adjacent pair of said needle loops of said first loop-forming yarns are spaced by at least one intervening wale.

4. A warp knitted textile fabric according to claim 1, wherein said elongated underlap loops of said first loop-forming yarns extend outwardly from the technical back of said fabric in opposite directions coursewise of said fabric.

5. A warp knitted textile fabric according to claim 1, wherein said first loop-forming yarns are warp knitted in a 1–0, 3–4, 6–7, 3–4 stitch pattern.

6. A warp knitted textile fabric according to claim 1, wherein each said second loop-forming yarn is formed in needle loops aligned with one another in spaced courses of a common wale.

7. A warp knitted textile fabric according to claim 1, wherein each walewise adjacent pair of said needle loops of said second loop forming yarns are spaced by at least one intervening course and each coursewise adjacent pair of said needle loops of said second loop-forming yarns are spaced by at least one intervening wale.

8. A warp knitted textile fabric according to claim 1, wherein said needle loops of said first and second loop-forming yarns are formed in common courses and wales.

9. A warp knitted textile fabric according to claim 1, wherein said second loop-forming yarns are warp knitted in a 1–0, 3–4 stitch pattern.

10. A warp knitted textile fabric according to claim 1, wherein said ground yarns are warp knitted in a 2–3, 1–0 stitch pattern.

11. A method of producing a warp knitted textile fabric having a first set of loops extending from the technical face of the fabric for adhering to a backing material and a second set of loops extending from the technical back of the fabric for mated engagement with hooking elements of another fabric for use in a two-component fabric fastener of a hook-and-loop type, said method comprising the steps of:

providing a warp knitting machine having at least top, middle and bottom yarn guide bars and a needle bar supporting a series of needles;

warp knitting a set of ground yarns on said middle guide bar to form a ground layer of said fabric in a stitch pattern which is relatively stretchable in a warpwise extent of said fabric;

simultaneously warp knitting a first set of loop-forming yarns on said top guide bar by alternately forming needle loops of said first loop-forming yarns on selected needles and interveningly holding said first loop-forming yarns in a non-knitting manner on, and then releasing said first loop-forming yarns without stitch formation from, other needles spaced from said selected needles, to form elongated underlap loops extending outwardly from the technical back of said fabric between said needle loops of said first loop-forming yarns; and simultaneously warp knitting a second set of loop-forming yarns on said top guide bar by alternately forming needle loops of said second loop-forming yarns on selected needles and interveningly holding said second loop-forming yarns in a non-knitting manner on, and then releasing said second loop-forming yarns without stitch formation from, other needles spaced from said selected needles, to form loops extending outwardly from the technical face of said fabric between said needle loops of said second loop-forming yarns.

12. A method of producing a warp knitted textile fabric according to claim 11 and further comprising warp knitting said first loop-forming yarns in a 1–0, 3–4, 6–7, 3–4 stitch pattern.

13. A method of producing a warp knitted textile fabric according to claim 11 and further comprising warp knitting said second loop-forming yarns in a 1–0, 3–4 stitch pattern.

14. A method of producing a warp knitted textile fabric according to claim 11 and further comprising warp knitting said ground yarns in a 2–3, 1–0 stitch pattern.

* * * * *

UNITED STATES PATENT AND TRADEMARK OFFICE
CERTIFICATE OF CORRECTION

PATENT NO. : 5,267,453

DATED : December 7, 1993

INVENTOR(S) : William L. Peake, III, Robert T. Spillane and Paul R. Heubner

It is certified that error appears in the above-identified patent and that said Letters Patent is hereby corrected as shown below:

Column 3, line 66, delete "round" and insert therefor -- ground --.

Column 4, line 26, delete "references" and insert therefor -- reference --.

Column 7, line 41, delete "relative" and insert therefor -- relatively --.

Column 8, line 15, delete "in" and insert therefor -- is --.

The title page should be deleted to be replaced with per attached title page.

Figures 1 and 2 should be deleted to be replaced with figures 1 and 2 as shown on the attached sheets.

Signed and Sealed this

Twenty-second Day of November, 1994

*Attest:*

Bruce Lehman

BRUCE LEHMAN

*Attesting Officer*

*Commissioner of Patents and Trademarks*

United States Patent [19]

Peake, III et al.

[11] Patent Number: 5,267,453

[45] Date of Patent: Dec. 7, 1993

[54] LOOP-TYPE TEXTILE FASTENER FABRIC AND METHOD OF PRODUCING SAME

[75] Inventors: William L. Peake, III; Robert T. Spillane, both of Greensboro, N.C.

[73] Assignee: Guilford Mills, Inc., Greensboro, N.C.

[21] Appl. No.: 34,088

[22] Filed: Mar. 22, 1993

Related U.S. Application Data

[63] Continuation-in-part of Ser. No. 711,201, Jun. 6, 1991, Pat. No. 5,214,942.

[51] Int. Cl.[5] ..... D04B 23/08; A44B 18/00

[52] U.S. Cl. ..... 66/194; 66/193; 24/445

[58] Field of Search ..... 66/193, 194; 24/445

[56] References Cited

U.S. PATENT DOCUMENTS

| | | | |
|---|---|---|---|
| 3,594,873 | 7/1971 | Hockmeyer, Jr. et al. | |
| 3,597,941 | 8/1971 | Domazlice | |
| 3,603,117 | 9/1971 | Svoboda et al. | 66/194 X |
| 3,748,701 | 7/1973 | De Mestral | |
| 3,943,981 | 3/1976 | De Brabander | |
| 4,114,346 | 9/1978 | Kelly | |
| 4,338,800 | 7/1982 | Matsuda | |
| 4,467,625 | 8/1984 | Kurz | |
| 4,557,774 | 12/1985 | Hoopengardner | |
| 4,567,075 | 1/1986 | Krawczyk | 66/194 X |
| 4,624,116 | 11/1986 | Rogers | |
| 4,677,011 | 6/1987 | Matsuda | |
| 4,709,562 | 12/1987 | Matsuda | |
| 4,714,096 | 12/1987 | Guay | |
| 4,822,658 | 4/1989 | Pacione | |
| 4,838,044 | 6/1989 | Matsuda et al. | |
| 4,858,447 | 8/1989 | Matsuda | |
| 4,881,383 | 11/1989 | Spillane et al. | |
| 5,065,600 | 11/1991 | Byles | 66/194 X |

FOREIGN PATENT DOCUMENTS

| | | |
|---|---|---|
| 0062738 | 4/1981 | European Pat. Off. |
| 0223024 | 10/1985 | European Pat. Off. |
| 0284020 | 3/1987 | European Pat. Off. |
| 7030645 | 11/1970 | Fed. Rep. of Germany |
| 2201231 | 7/1973 | Fed. Rep. of Germany |
| 2647113 | 5/1977 | Fed. Rep. of Germany |
| 2803006 | 8/1979 | Fed. Rep. of Germany |
| 2150196 | 3/1973 | France |
| WO86/03164 | 6/1986 | PCT Int'l Appl. |
| 1204886 | 9/1967 | United Kingdom |

OTHER PUBLICATIONS

Guilford Mills, Inc., Warp Knitted Fabric Style No. 30000.

*Primary Examiner*—Clifford D. Crowder
*Assistant Examiner*—John J. Calvert
*Attorney, Agent, or Firm*—Shefte, Pinckney & Sawyer

[57] ABSTRACT

A lightweight warp knitted textile fabric suitable for use as the loop component of a hook-and-loop fastener is formed of a set of ground yarns knitted in a relatively stretchable construction with a first set of loop forming yarns formed in a stitch pattern producing elongated underlap loops extending outwardly from the technical back of the fabric which can be readily interengaged with the hook elements of a mating hook component without any necessity for brushing, napping or mechanically raising the loops and a second set of loop-forming yarns formed in a stitch pattern producing elongated loops extending outwardly from the technical face of the fabric which can be adhered to a backing material such as a carpet backing.

14 Claims, 2 Drawing Sheets

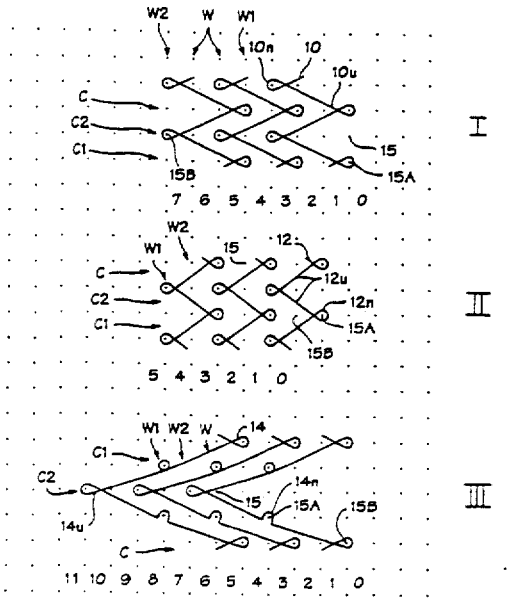

UNITED STATES PATENT AND TRADEMARK OFFICE

CERTIFICATE OF CORRECTION

PATENT NO. : 5,267,453

DATED : December 7, 1993

INVENTOR(S) : William L. Peake, III, Robert T. Spillane and Paul R. Heubner

It is certified that error appears in the above-identified patent and that said Letters Patent is hereby corrected as shown below:

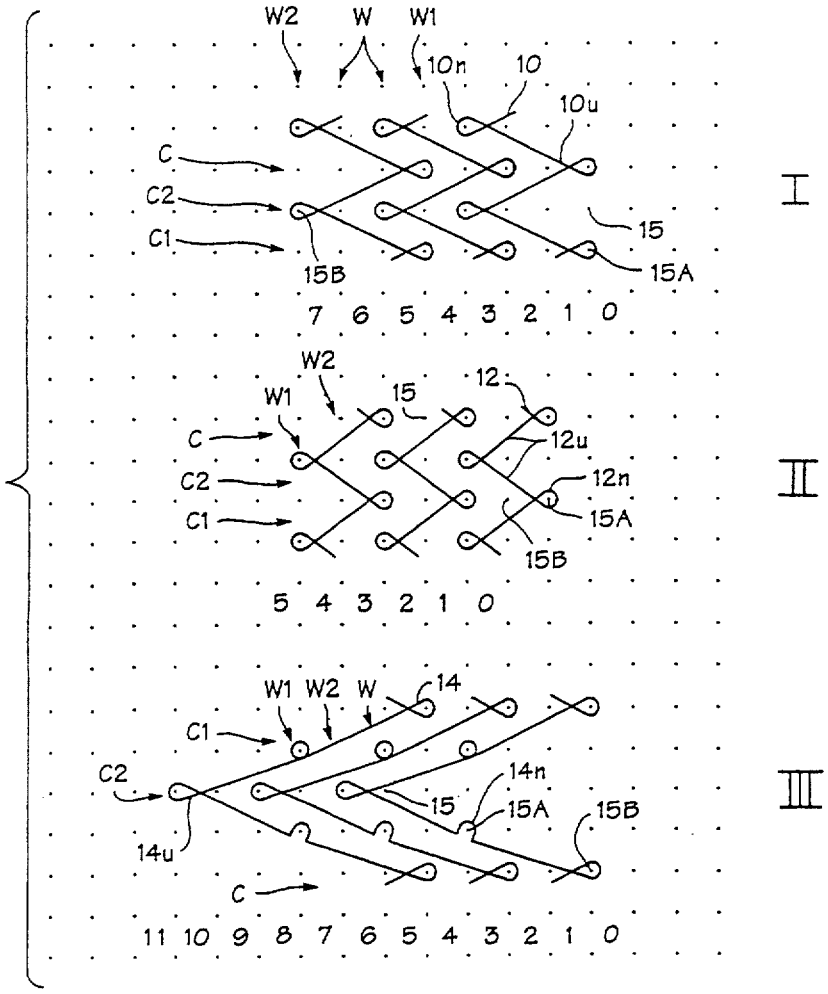

UNITED STATES PATENT AND TRADEMARK OFFICE

CERTIFICATE OF CORRECTION

PATENT NO. : 5,267,453

DATED : December 7, 1993

INVENTOR(S) : William L. Peake, III, Robert T. Spillane and Paul R. Heubner

It is certified that error appears in the above-identified patent and that said Letters Patent is hereby corrected as shown below:

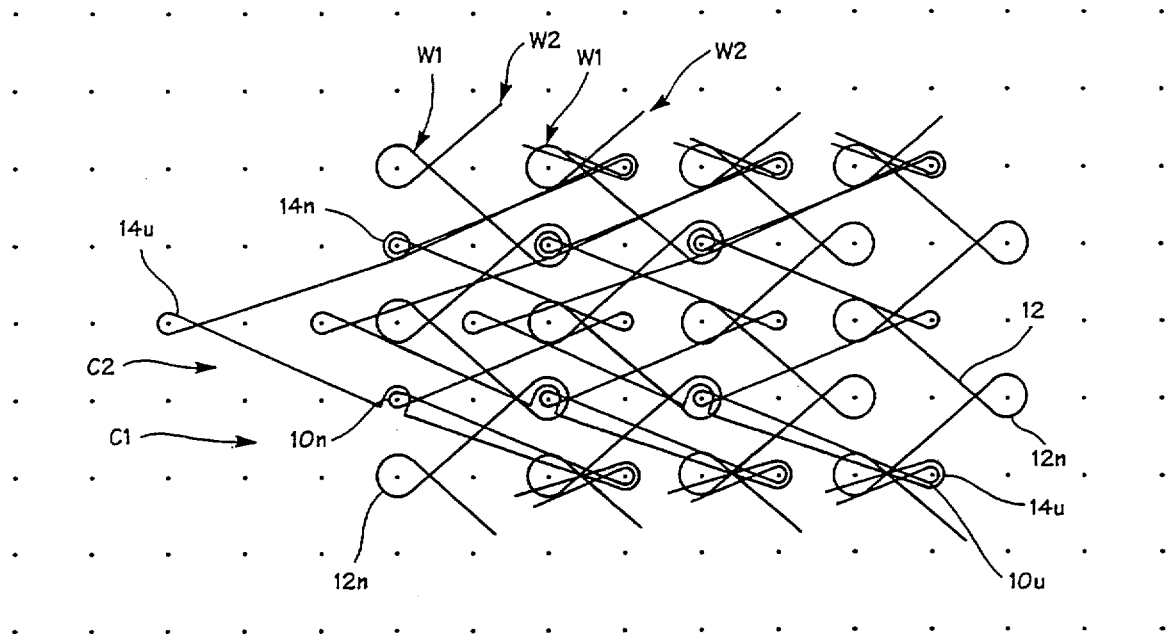

Fig. 2